US006367565B1

(12) United States Patent
Hall

(10) Patent No.: US 6,367,565 B1
(45) Date of Patent: Apr. 9, 2002

(54) MEANS FOR DETECTING SUBTERRANEAN FORMATIONS AND MONITORING THE OPERATION OF A DOWN-HOLE FLUID DRIVEN PERCUSSIVE PISTON

(76) Inventor: David R. Hall, 2185 S. Larsen Pkwy., Provo, UT (US) 84606

( * ) Notice: Subject to any disclaimer, the term of this patent is extended or adjusted under 35 U.S.C. 154(b) by 0 days.

(21) Appl. No.: 09/049,218

(22) Filed: Mar. 27, 1998

(51) Int. Cl.[7] ..... E21B 4/00; E21B 10/36
(52) U.S. Cl. ..... 175/50; 175/296
(58) Field of Search ..... 175/45, 50, 65, 175/215, 414, 417, 293, 296

(56) References Cited

U.S. PATENT DOCUMENTS 5,798,488 A * 8/1998 Beresford et al. ..... 175/50 X
5,803,186 A * 9/1998 Berger et al. ..... 175/50
5,852,587 A * 12/1998 Kostek et al. ..... 175/50 X
5,883,516 A * 3/1999 Van Steenwyk et al. .. 175/50 X

* cited by examiner

*Primary Examiner*—Frank S. Tsay

(57) ABSTRACT

A method of creating an electric signal that describes the motion of a down-hole, fluid-driven percussive tool is disclosed. The signal is obtained by attaching an electromagnetic transducer to the percussive tool, the member impacted by it, or the drill string. The rebound characteristics of the tool yield a measurement of the physical characteristics of the subterranean formation being penetrated. The tool's position over time is useful for diagnosing and regulating the operation of the tool. The transducer can also be configured to generate a signal large enough to be used as a power source.

13 Claims, 5 Drawing Sheets

(Section B–B)

(Section A–A)

MEANS FOR DETECTING SUBTERRANEAN FORMATIONS AND MONITORING THE OPERATION OF A DOWN-HOLE FLUID DRIVEN PERCUSSIVE PISTON

CROSS-REFERENCES TO RELATED APPLICATIONS

None

BACKGROUND

This invention relates to an apparatus for detecting the relevant properties of subterranean formations while drilling wells for oil, natural gas, and geothermal energy. More specifically, the invention relates to the measurement of the linear rebound position, velocity, and acceleration of a down-hole fluid-driven percussive piston which impacts a drill bit, thus penetrating the subterranean formations. Such pistons are referred to in the industry as "down-hole hammers," examples of which are disclosed in U.S. Pat. Nos. 5,396,965, 5,488,998, and 5,497,839. U.S. Pat. No. 5,396,965 discusses in detail the principles involved in the operation of a down-hole hammer actuated by drilling mud. These patents are incorporated herein. Drilling mud is only one of a number of different fluids used to drive down-hole hammers; any gas or liquid such as air, water, brine, or a foam combination could drive the mechanism upon which this invention is based.

The materials to be penetrated by such a drill vary by the type, depth, and location of the well. Knowledge of the lithology being drilled assists the drilling crew in the selection of drilling parameters and indicates when a "pay zone" is near. Thus, it would be very useful to obtain information about the physical characteristics of the formations being drilled. Specifically, it is helpful to know the hardness of the formations, their approximate composition, and whether or not they are part of a subterranean fracture. This would allow the surface team to steer the bit towards places where the type of energy being sought can be efficiently acquired. In the drilling process, it is also advantageous to optimize the drilling rate to minimize labor and tool replacement costs. The optimum set of conditions such as frequency of hammer impact, force of impact, presence of pulsed jet action, and rotational speed of the drill bit, varies by the hardness, depth, and composition of the formations being drilled. For example, impact-resistant diamond cutters that have a long life in medium hardness rock will tend to decompose and wear away under the high temperatures generated by drilling through hard, abrasive formations. If real-time data on the characteristics of the subterranean formations being penetrated could be acquired, a control system could be implemented to adapt the drilling conditions to the type of rock encountered.

When two objects collide, the energy with which they rebound depends upon the elasticity and hardness of both. Thus, an analysis of the rebound characteristics (position, velocity, and acceleration over time) of the hammer will also reveal the hardness and general makeup of the formations in contact with the bit. The harsh environment in which the hammer operates makes conventional measurement methods impractical; potentiometers, interferometers, and other instruments that measure displacement will not function well in the presence of high-pressure abrasive fluids, vibrations, and impact forces. There is a need for some novel method of discovering the hammer's position, velocity, and acceleration during the short period of time after it strikes the drill bit.

Additional utility would attend such a method if it could measure the position, velocity, or acceleration of the hammer at other points in its reciprocating motion as well. For example, simple knowledge of the impact velocity or frequency of the hammer may be used to help detect wear or malfunction of the hammer. As a second example, knowledge of the position of the hammer may enable the use of more flexible electromechanical valves to control hammer motion. In typical hammer mechanisms, such as those described in the patents above, the only variables that can be altered during drilling are the pressure or flow rate of fluid entering the drill string. This allows the drilling team to control only the frequency and force of impact, both of which must simultaneously increase or decrease. Optimization of the drilling process requires more control over the motion of the hammer, some of which can be attained through the use of computer-controlled valves. These would allow the drilling crew to dynamically modify the stroke of the hammer, thus, for example, increasing the hammer frequency while decreasing the force of imp act, etc. This type of control system would need data describing the hammer's displacement over its full range of motion.

Several different types of transducers exist; they are based upon principles such as variable resistance, optical interference, acoustic rebound, piezoelectric excitation, and magnetic flux variance. The following are examples of some that could be configured to measure the motion of the piston.

One means of optical measurement is the interferometer. It functions by focusing a beam of coherent light through a beam splitter. One part of the beam bounces off of a stationary mirror while the other bounces off of a moveable mirror; when the two returning beams are simultaneously visible, differences in the observed wavelengths indicate the displacement of the moveable mirror. In hammer machines that run on transparent fluids such as air, this can be used to determine the location of the piston over time.

Acoustic rebound transducers utilize sonic or ultrasonic waves and measure the speed of a passing object by utilizing such phenomena as the "Doppler effect."

Variable resistance transducers include potentiometers, which measure the displacement of an electrical contact along a coil of wire. The wire of the coils is of a known resistivity; when the contact closes the circuit with a known voltage source by touching one of the coils, the resulting output voltage is proportional to the length of wire the current must travel through. Thus, the voltage is a measure of the relative displacement of the contact and the coil.

Piezoelectric transducers function based on the unique tendency of some materials, such as single crystal quartz, to develop a charge when subjected to a mechanical strain. The charge generated is proportional to the force on the crystal; thus, the piezoelectric load cell can be used to measure force. This, in turn, yields a measurement of the acceleration when the load cell is attached to a moving object such as the piston; the weight of the cell will press on the crystal to produce a measurable charge in proportion to the magnitude of the acceleration. Since they measure changes in force, piezoelectric crystals can also readily be configured to measure pressure changes in fluids. Such a pressure transducer mounted in the fluid cavity above the piston or likewise on the drill string closer to the point of impact would yield data that generally describes the motion of the hammer, as derived from the cyclical fluid pressure variations.

There are also other types of transducers that operate based on measurement of changes in magnetic flux. Linear variable displacement transducers, or LVDT's, have one coil wrapped around a magnetically permeable core. When the core moves between two other concentric coils, the ac voltage through the first coil will excite a voltage output in the other two in proportion to the core's proximity to them. Thus, the LVDT measures the location, or displacement, of the core.

When the piston strikes the impact mass, there are two components to its motion: the transient response and the steady response. The transient response is the portion of the waveform induced as a direct result of the impact; its amplitude upon impact is significant but drops to zero before the end of the cycle. The steady response is the normal, near-sinusoidal waveform of the piston's motion resulting from the fluid pressures that actuate it. The transient response yields information regarding the impact and consequently the physical makeup of the formations being impacted. The steady response describes the piston's general motion and therefore provides data that can be used to deduce the piston's frequency, stroke length, and impact force.

For the analysis of subterranean features as well as diagnostic testing of the hammer's operation, the displacement, velocity, and acceleration of the piston are all useful quantities. If one is known, the other two can be determined from it by integration or differentiation. However, since the piston does not always strike the impact mass or reach the same point at the top of its stroke, there may be a need for a position datum if displacement is not the variable being directly measured. In other words, it might be necessary to know at which point in time the piston reaches a certain position once each cycle because inaccuracies in the integration over time may build up and yield an inexact measurement of the position of the piston. The sensor could be a simplified version of any of the displacement transducers discussed above, as it only needs to provide a simple signal to indicate that the piston has reached the predetermined position.

For the invention, the magnetic flux-based transducer was chosen as the most viable for down-hole applications. Lateral vibrations in the piston's movement, abrasive down-hole conditions, and high velocities make it difficult to use any transducer in which the moving and stationary parts must be in contact with each other, such as the potentiometer. It is similarly impractical to extend any wires from the piston to a stationary part of the drill string because the piston's motion will tend to break the wires in fatigue while the abrasive effects of the drilling fluid will rapidly wear away exposed electrical conductors. For these reasons, it is desirable to use a transducer in which the only communication between moving and stationary parts does not require contact between the piston and the drill string. A magnetic coupling accomplishes this criterion and provides a particular advantage for down-hole applications, since such a coupling may operate in typically opaque drilling mud. Although either permanent or electrically activated magnets can be used, permanent magnets are preferable for mounting in a hammer piston because they reduce the number of electrical contacts required.

Yet further functionality of the above-mentioned measurement method is apparent when one considers that an electrical signal generated by this method may be useable as an electrical power source. Data acquisition, data transmission, and control systems, as described above, require a steady source of power down-hole. Due to the time and expense required to retrieve the drill from the borehole, it is critical to find a power system that will operate for as long as possible without the need for maintenance or replacement. A down-hole power system should be designed to operate for at least 100 hours.

Several methods of providing electricity down-hole have been tested with limited success. New lithium technology currently being implemented in batteries cannot provide a long enough life to be useful for powering complex systems down-hole. The abrasive environment makes turbines and other bladed rotary generators particularly short lived. The motion of the down-hole hammer, however, may be used to provide the needed means of down-hole electricity generation.

The present invention is a method of measuring the motion characteristics of the hammer through the use of a transducer mounted on the piston, drill bit, or drill string. A transducer is a device that converts one form of energy to another. Thus, in this invention, a portion of the energy resident in the hammer is converted into electrical energy. The present invention thus becomes not only a motion sensor, but also an electrical generator.

The preferred embodiment of the transducer consists of a series of coils and magnetic flanges mounted inside the hammer. In this embodiment, the transducer will provide valuable information on the transient and steady motion of the hammer in the form of an electric signal strong enough to constitute a power source.

SUMMARY

The present invention constitutes a method for satisfying three functional needs in implementing down-hole control, measurement, and telemetry systems. This device provides a means of measuring the hammer's impact characteristics, a means of determining its general displacement profile over time, and a means of generating electrical power for use in down-hole systems.

Combining existing technologies solves these problems. First of all, fluid-driven hammers, as shown in U.S. Pat. Nos. 5,396,965, 5,488,998, and 5,497,839 are used to convert hydraulic pressure to linear kinetic energy. Linear alternators, such as those described in U.S. Pat. Nos. 4,454,426, 4,602,174, 5,180,939, and 5,389,844 convert linear kinetic energy to electrical energy. These patents are incorporated herein. The amplitude of the electric waveform produced is in proportion to the velocity of the linear reciprocator.

The basic principles are as follows. When a magnetic field passing through a coil changes in strength or orientation, a voltage is induced in proportion to the change in the field divided by the time required for the change to occur. This principle is commonly used to convert between mechanical and electrical forms of energy. The relative motions of the magnets and the coils can be rotational or linear. Linear reciprocating elements have been used as components for linear motors and alternators, such as those disclosed in U.S. Pat. Nos. 4,454,426 and 4,602,174, as well as measurement devices such as linear variable displacement transducers (LVDT's). A coil and magnet system is used to measure the location of a compressor piston with respect to the cylinder head in U.S. Pat. No. 5,342,176, incorporated herein by this reference.

The preferred embodiment of this invention utilizes permanent magnets mounted on a stationary member in the hammer housing. Coils are also mounted on a stationary member and the motion of the hammer (a mass of magnetic material) past the permanent magnets causes a changing flux field. This changing flux field induces a current in the coils, which can be measured and used to feed electrical devices. In a second embodiment of this invention, the magnets may be mounted on the hammer, which reciprocate with respect to coils mounted on a stationary member in the hammer housing. Similarly, the measurement device can be mounted on the drill bit, which will display a similar rebound characteristic. The hammer's position and acceleration can also be obtained by integration and differentiation, respectively. This yields the desired information concerning the rebound and general motion of the hammer.

The voltage induced by such a configuration produces an alternating current waveform. If the magnetic field is strong and there are a large number of coils, the amplitude of the waveform will be large enough to constitute a signal useful as a power source. See U.S. Pat. No. 4,491,738, incorporated herein, for an example of a machine that generates small amounts of electricity down-hole independent of a hammer.

DETAILED DESCRIPTION

Figure 1:
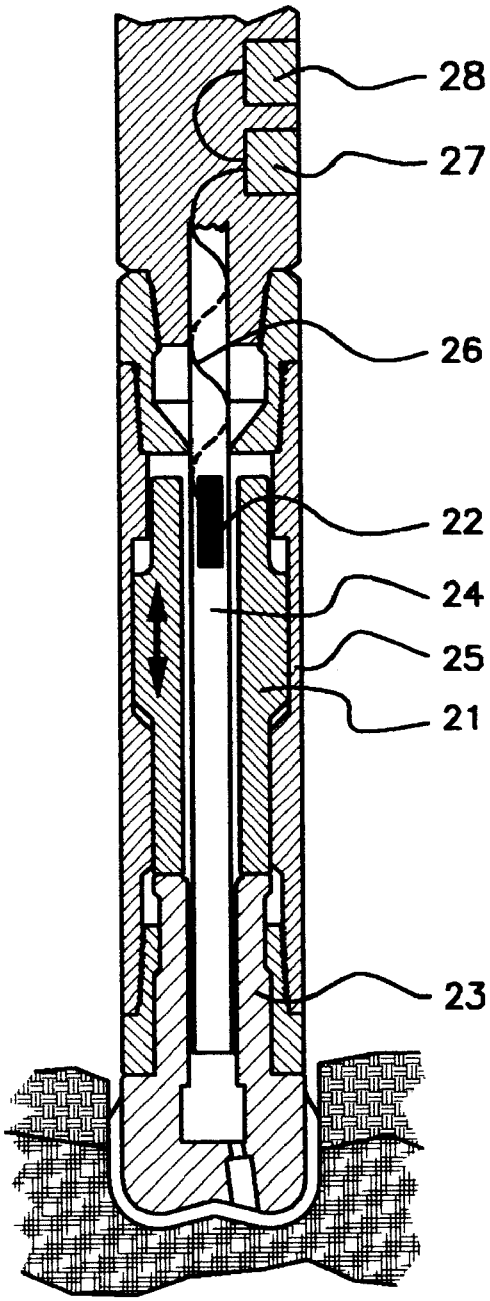
FIG. 1 is a sectioned view of the cylindrical hammer subassembly that shows the transducer (mounted in the hammer housing), signal-conveying wires, and signal analysis and rectification modules.

FIG. 1 depicts the invention in generalized form. The hammer 21 is shaped like a large tube surrounding the throat 24 and, in turn, surrounded by the wall of the drill string 25. The hammer is actuated by one or more valves (not shown—see U.S. Pat. No. 5,396,965 for details on the operation of one particular hammer design). The hammer 21 reciprocates in axial fashion and at the bottom of its stroke, strikes the top of the drill bit 23. The drill bit 23 is designed to transmit the impact of hammer 21 to the rock below.

The transducer 22 is one of several types that measure position, velocity, or acceleration. It can be one of the optical, acoustic, variable resistance, piezoelectric, or, most preferably, magnetic flux-based type. The transducer 22 is preferably mounted to the throat 24 and generates an electric current as the hammer 21 moves. The electric current travels through the wires 26 to reach the signal processor 27. The signal processor 27 reads the electric current from the hammer transducer 22 and interprets it to provide an output signal which describes the position, velocity, or acceleration of the piston 21; this signal can be analyzed by the surface crew or a down-hole computer. Other transducers similar to that of FIG. 1 may be placed on the throat 24 or the drill string 25 to provide additional information regarding the position, velocity, or acceleration of the piston 21.

The substantially sinusoidal signal generated by the transducer 22 continues on to the power supply circuitry 28 which adjusts its waveform to a direct current form (or conditioned alternating current) of the proper voltage required by down-hole devices. The output from the power supply circuitry may be used as the power source for electric down-hole components.

Figure 2:
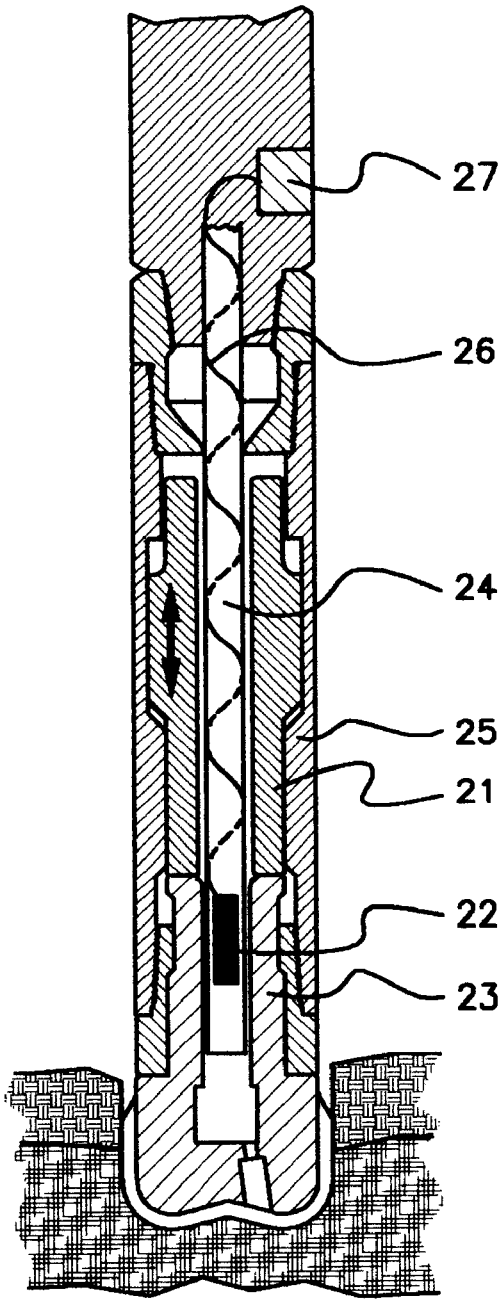
FIG. 2 is a sectioned view of the same hammer subassembly with the transducer mounted on the drill bit.

FIG. 2 shows a similar system with the transducer 22 located inside the drill bit 23. When the hammer 21 strikes the bit, the rebound characteristics of the bit will be similar to that of the hammer 21. The current once again passes through the wire 26 to reach the signal processor 27. A power supply may be added in this case as well, although the power output of this particular design will be much lower than that shown in FIG. 1, due to the small relative motion of the hammer bit 23.

Figure 3:
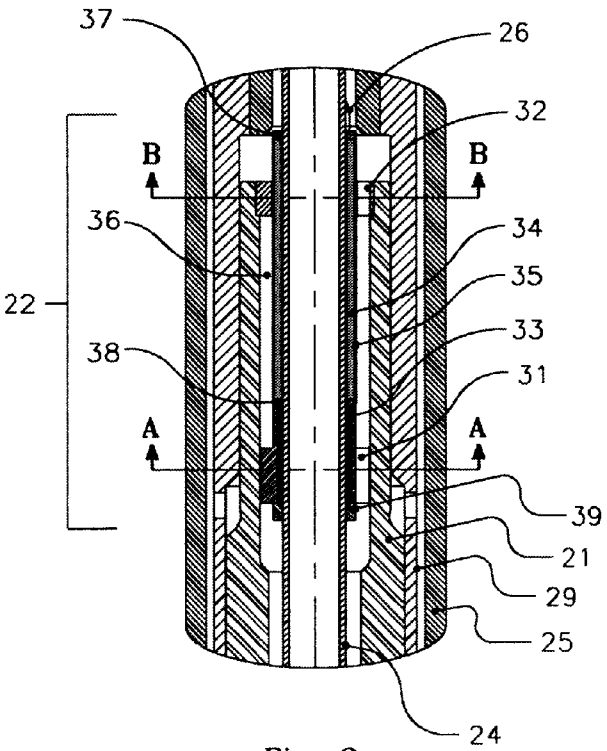
FIG. 3 is a sectioned view of the preferred embodiment of the transducer/generator mounted in the hammer housing.

FIG. 3 is a sectioned view of the preferred embodiment of the transducer 22, attached to the throat 24 as in FIG. 1. The inner wall of the hammer 21 has been bored out to accommodate the transducer 22. Both hammer 21 and throat 24 are constructed from ferritic or otherwise magnetic materials, such as mild or high strength steels. A lower flange 31, also constructed from magnetic material, is securely positioned on throat 24 by retainer rings 38 and 39. Between the bore of the lower flange 31 and the throat 24 are located a plurality of permanent magnets 33. The lower flange is constructed so as to reside, at least in part, in close proximity to the inner wall of hammer 21. Just uphole of the lower flange 31, is located a continuously wound coil of insulated electrical wire 34, which is wrapped around the throat 24. A non-magnetic retainer ring 37 rests against the top of the coil 34 and maintains the axial position of the coil 34. A non-magnetic sleeve 35 encloses the coil 34 and separates it from the fluid space 36. The upper flange 32 encircles the coil 34 in close proximity. The upper flange is constructed of magnetic material, and is fixedly attached to the inner wall of the hammer 21.

The magnets 33 are of radial polarity: each magnet has its north pole on the outer face and its south pole on the inner face. The magnets 33 are constructed of a magnetic material such as Alnico, neodymium, samarium cobalt, or a magnetic ceramic. The retainer rings 37, 38, and 39 are constructed of some material with low magnetic permeability, such as 300 series stainless steel.

The signal-conveying wire 26 is an extension of the wire coils 34 and is wrapped around the throat 24 in a spiral configuration so that it carries the current to the signal processor 27 (shown in FIG. 1).

The wire coils 34, composed a material of low electrical resistivity, are insulated from each other and enclosed by a nonmagnetic sleeve 35 which protects them from the abrasives in the drilling fluid. The sleeve 35 can be composed of an austenitic (a nonmagnetic molecular phase) stainless steel, chrome, ceramic or some similar hard substance which is nonmagnetic, abrasion-resistant, and applicable at low temperatures. Similarly, the sleeve 35 might also consist of a soft polymer or elastomer that will resist wear by abrasive elements in the drilling fluid.

The fluid space 36 extends through the bore of hammer 21 and provides fluid communication between a cavity above the hammer 21 and a cavity below it. The magnetic flanges 31 and 32, the sleeve 35, and the retainer rings 37, 38, and 39 are dimensioned such that they allow mud to flow past them without significant pressure drop.

Figure 4:
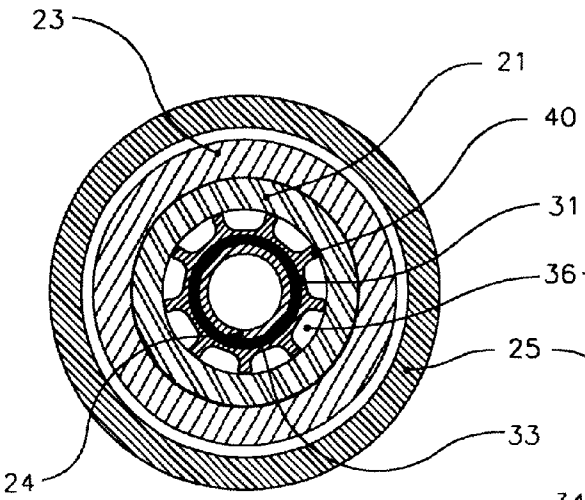
FIG. 4 is a sectioned view of the portion of the hammer containing the transducer, in a region towards the bottom of the transducer (section A—A in FIG. 3); it shows the layout of the magnetic rings and flanges.

FIG. 4 is a cross section of the preferred embodiment of the transducer 22, as seen from along the axis of the drill string. This figure shows the radial orientation of the throat 24, the magnets 33, the lower flange 31, and the piston 21. As shown, fingers 40 protrude outward from the body of the lower flange 31, so as to obtain dose proximity with piston 21, while still providing space for mud to flow past the flange (see fluid space 36). The flange 31 is constructed of steel, iron, or some similar material with a high magnetic permeability.

Figure 5:
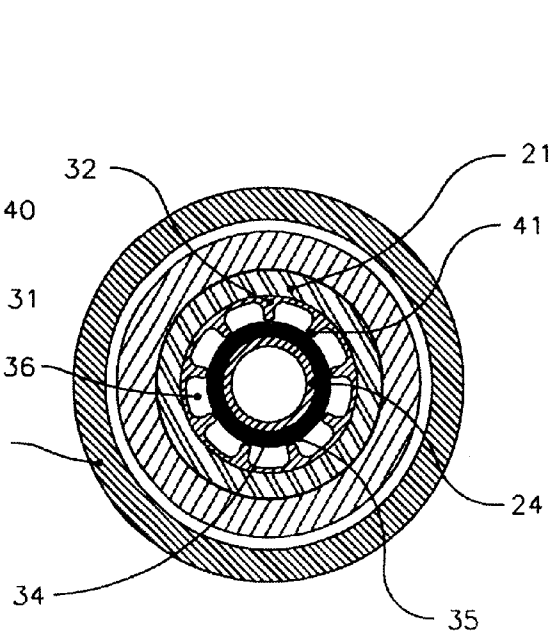
FIG. 5 is a sectioned view of a region towards the top of the hammer transducer (section B—B in FIG. 3).

FIG. 5 is a second cross section of the preferred embodiment of the transducer 22 as seen from along the axis of the drill string. This figure shows the radial orientation of the throat 24, coils 34, sleeve 35, upper flange 32, and piston 21. As shown, fingers 41 protrude inward from the body of the upper flange 32, so as to obtain close proximity with coils 34, while still providing space for conducting flow past the flange (see fluid space 36). The flange 32 is constructed of steel, iron, or some similar material with a high magnetic permeability.

Figure 7:
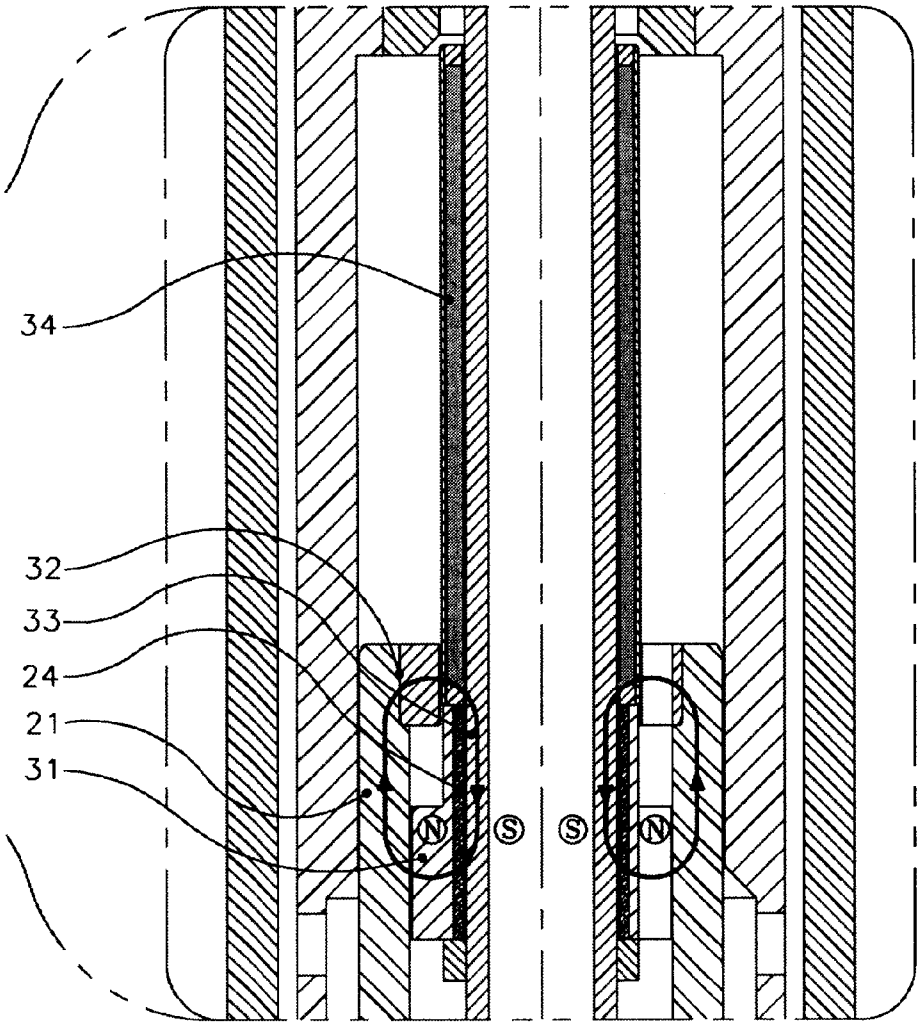
FIG. 7 is a blowup of the portion of FIG. 6 contained by the dotted lines. The arrows represent the path of the magnetic flux.
Figure 6:
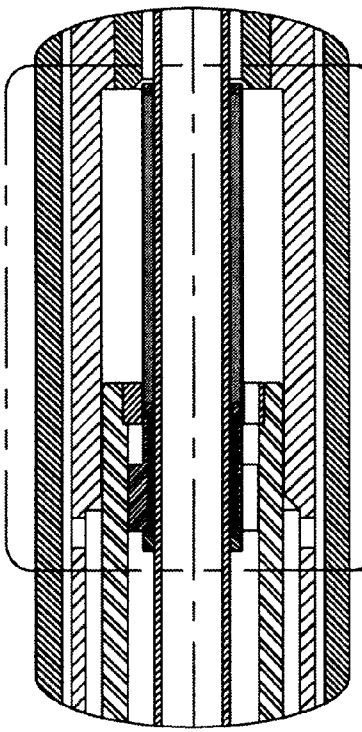
FIG. 6 is the view shown in FIG. 3; the hammer is near the bottom of its stroke.

FIG. 6 is the same cross-sectional view as that shown in FIG. 3, except the hammer 21 is shown near the bottom of its stroke. FIG. 7 is a magnified view of part of the transducer 22 in FIG. 6. A high-permeability path through the coils 34 exists, due to the close proximity of flanges 31 and 32 with the hammer 21 and coil 34 respectively. This path is shown by the bold arrows in the figure. The magnetic flux will travel through this path to complete the circuit between the north and south poles.

Figures 8, 9:
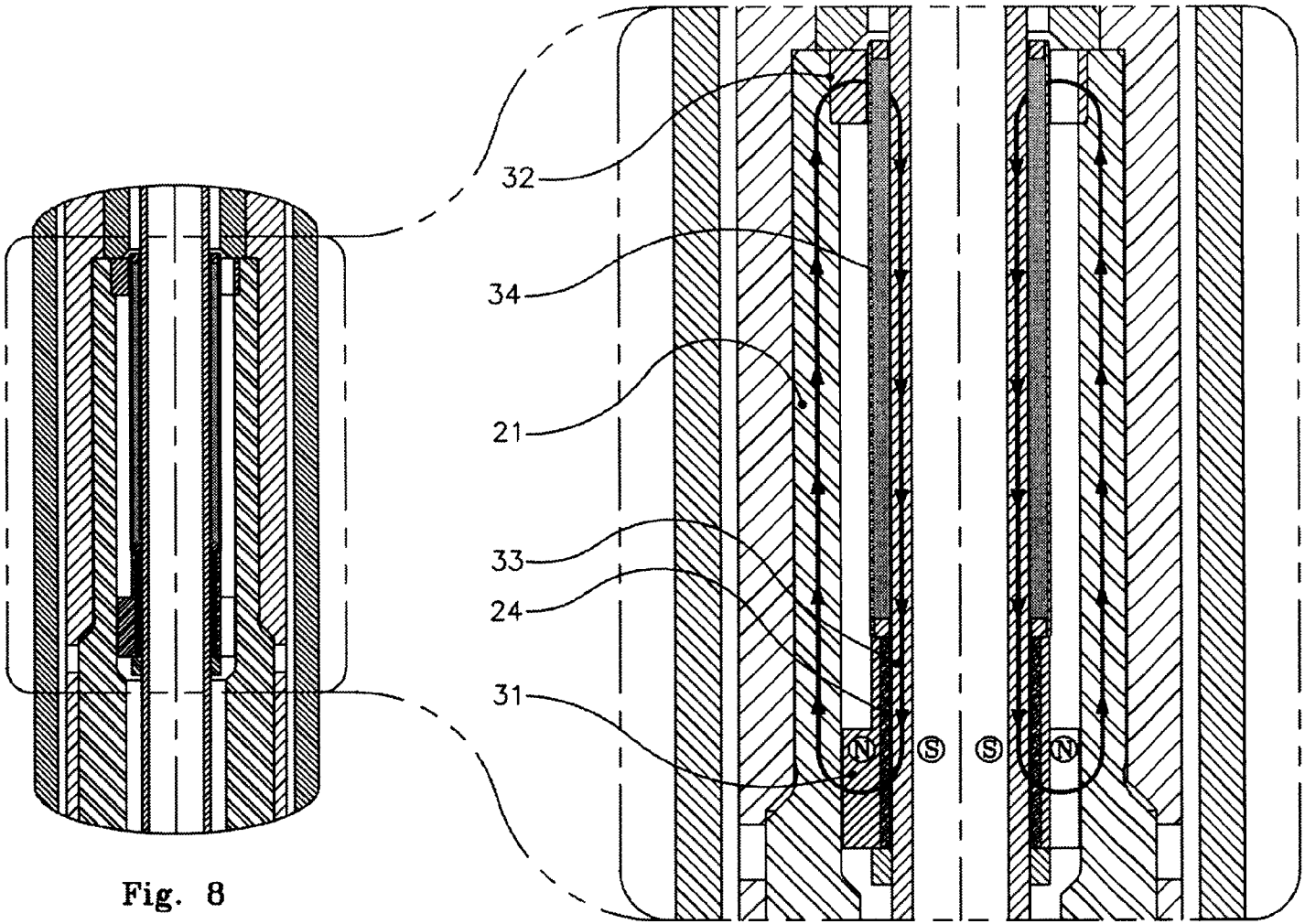
FIG. 8 is the sectioned view of FIG. 3 depicting the hammer near the top of its stroke.
FIG. 9 is a blowup of FIG. 8. The arrows represent the path of the magnetic flux.

FIG. 8 is similar to FIG. 6, except that it shows the hammer 21 near the top of its stroke; FIG. 9 depicts the resulting flux paths. The flux will now travel through a longer path around the coils because the upper flange 32 has moved to the top of the coils, thereby increasing the length of the high-permeability flux path.

Operation of the transducer 22 proceeds as follows. As the hammer 21 oscillates, the magnetic flux path will vary from that shown in FIG. 7 to that shown in FIG. 9. As per Faraday's law of induction, any change in magnetic flux through the coils 34 will generate a voltage, and therefore, induce an electric current in the coils 34. This electric signal is proportional to the rate of change of the magnetic flux, which is proportional to the velocity with which the hammer 21 moves. Thus, this signal is a measure of the speed and direction of the motion of the hammer 21. The principles involved in generating electricity by manipulating magnetic flux are described in detail in U.S. Pat. Nos. 4,454,426 and 5,342,176. Although the drawings depict a single coil and a single array of magnets, several coil/magnet couples may be used to increase the magnitude or quality of the output signal.

Figure 11:
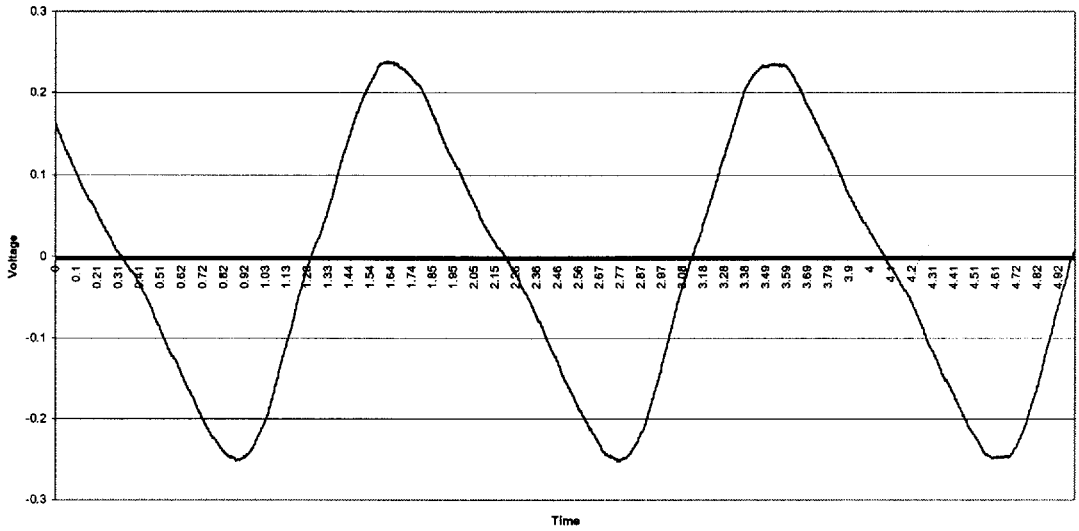
FIG. 11 is a graph that shows the signal generated by the preferred embodiment transducer over time.
Figure 10:
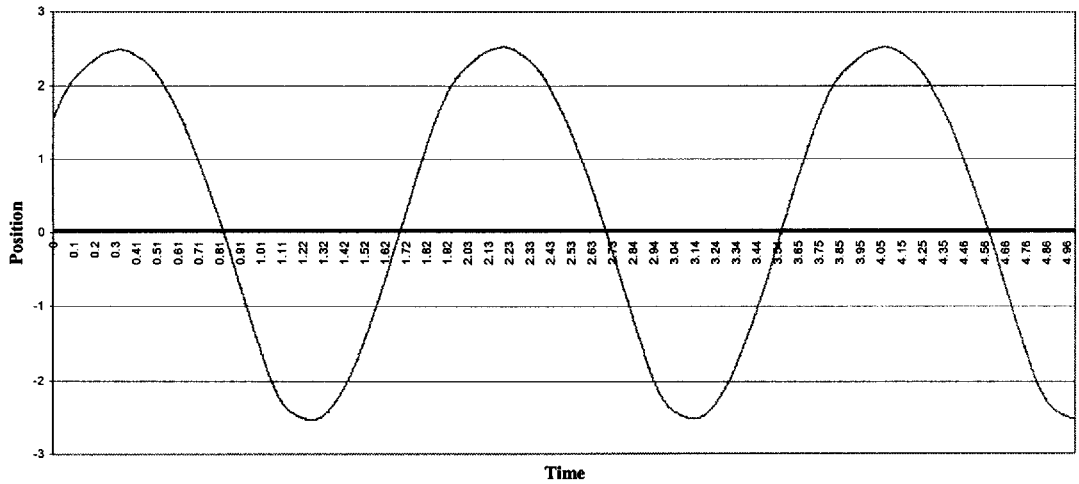
FIG. 10 is a graph that shows the motion of the hammer over time, as simulated by a testing apparatus that incorporates the preferred embodiment transducer.

FIG. 10 shows the position of the hammer 21, as measured by a position sensor mounted on a testing apparatus designed to simulate its motion. FIG. 11 is a sample of testing data that shows the voltage induced by the motion in FIG. 10. This voltage is proportional to the velocity of the hammer, which can be obtained by taking the time derivative of the hammer position shown in FIG. 10.

In practice, the transducer will yield a signal lie that of FIG. 11 which must be integrated and scaled to give the position of the hammer. The signal processor 27 can perform this function in a number of different ways including numerical integration and curve-fitting in conjunction with mathematical integration.

Figure 12:
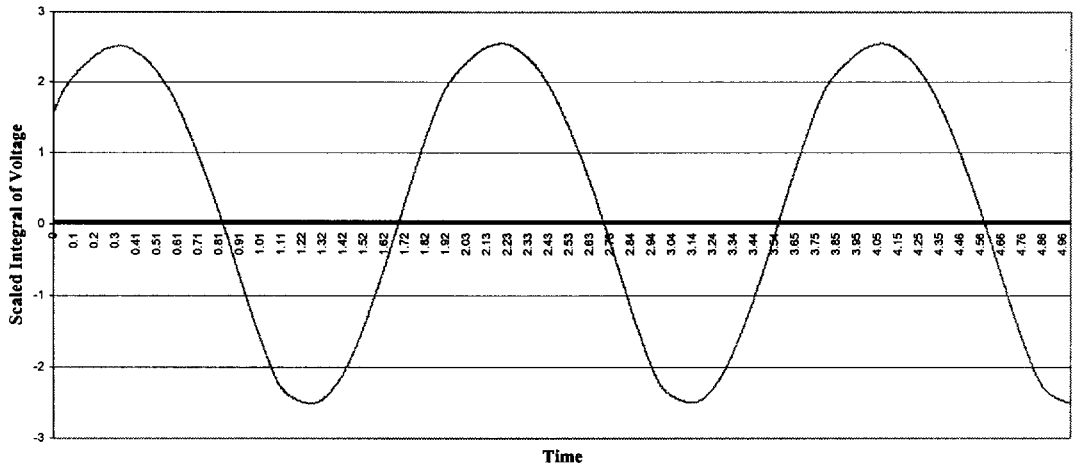
FIG. 12 is a graph of the scaled numerical integral of the testing data shown in FIG. 11, as obtained through the trapezoidal method.

There are several well-known algorithms the signal processor 27 can use to numerically integrate the voltage signal of FIG. 11. Two of these are the trapezoidal method and Simpson's rule. The integral of a function is simply the area between the function and the axis that represents zero. The trapezoidal method and Simpson's rule both separate the function into a series of narrow strips; the end of the strip can be approximated as a straight line, as in the trapezoidal method, or a polynomial curve, as in Simpson's Rule. The areas of the strips can be easily computed and added to form a fairly accurate estimate of the area between the function and the zero axis. The signal processor 27 would form a new strip after it takes each voltage measurement; by adding the area of this strip to the sum of the areas previously calculated, the signal processor 27 would keep a running integral of the voltage. FIG. 12 is the scaled numerical integral of the testing data shown in FIG. 11, as obtained through the trapezoidal method. With some small deviations, its shape is very similar to that of the output of the position sensor, which is shown in FIG. 10.

There are also several well-known methods that could be used to approximate the voltage output of the transducer as a function that can be mathematically integrated. The voltage output can be fit to sinusoidal, polynomial, or exponential waveforms; combinations of mathematical functions can also be used. As a further alternative to the digital numerical methods described above, an analog integrator and amplifier may be constructed to give position information.

Power supplies are readily available to convert one electric signal to another as required by the load, or the device that requires power. Since most down-hole devices require DC power, the power supply of FIG. 1 would convert the signal from the AC output of the transducer to a DC waveform. The power supply could also incorporate a battery, capacitor, or both to store up voltage for times when the power required exceeds the transducer output.

What is claimed is:

1. A tool for detecting the properties of a subterranean formation being drilled and or the operation of a down-hole hammer, comprising:

a. at least a portion of a drill string and or a throat;

b. a fluid driven, percussive piston capable of producing a linearly reciprocating motion;

c. at least a portion of the drill string and or the throat in communication with the percussive piston;

d. a drill bit in communication with the piston, or the throat, or the drill string, or a combination thereof, and in communication with the subterranean formation being drilled;

e. the motion of the piston at least partially comprising a transient response and a steady response;

f. at least one transducer means for converting at least a portion of the motion of the piston into an electric signal; and g. a means for analyzing characteristics of the electric signal so as to provide a measurement of the transient response in order to detect the characteristics, including hardness, composition, and integrity, of the formation being drilled, and or to provide a measurement of the steady response in order to detect the piston's frequency, stroke length, and impact force.

2. The transducing means of claim 1(f) further comprising:

(a) A variable resistance position measurement system, (b) An optical measurement system, (c) An acoustic measurement system, (d) A piezoelectric acceleration measurement system, or (e) A measurement system based on magnetic flux variations.

3. The magnetic measurement system of claim 2(e) further comprising:

(a) A plurality of magnets, (b) A means for creating a low reluctance path for the magnetic flux, and (c) A plurality of coils mounted such that the magnetic flux through the coils will change over time, thereby inducing a time-varying electric signal.

4. The coils of claim 3(c) further being enclosed and isolated from the fluid by an abrasive-resistant material selected from the group consisting of an austenitic stainless steel, a chrome plating, an elastomer, or a ceramic.

5. The tool of claim 1 wherein the down hole-hammer further comprises a housing, a main flow passage, at least one valve means, an impact surface, a backhead, a shank, one or more supply ports and passageways, one or more exhaust ports and passageways, elastomeric seals, bearings, seals, sliding valves, seal rings, keyways and keys, splines, shims, tiles, chambers, at least a portion of a bottom hole assembly connected to a drill sting, and a fluid selected from the class of natural or synthetic drilling fluids comprising air, water, brine, mud, or foam, or a combination thereof.

6. The tool of claim 1 wherein the transducer means is mounted on the percussive piston, the drill bit, the throat, the drill string, or a combination thereof.

7. The tool of claim 1 wherein the means for analyzing characteristics of the electric signal further comprises a means for converting the electric signal to a measurement of the instantaneous velocity, position, and acceleration of the piston by integration and differentiation.

8. The tool of claim 1 wherein the transducer means further comprises a means for providing a position datum periodically during the operation of the percussive piston.

9. A tool for generating power from the motion of a fluid-driven percussive piston, comprising:

a. a transducing means comprising at least a portion of a drill string, a housing, a stationary member, permanent magnets, and coils;

b. a means for converting an electric signal to a form of usable electical power;

c. a fluid driven percussive piston capable of producing a linearly reciprocating motion;

d. the magnets and coils being mounted on the stationary member, or, alteratively, the magnets being mounted on the piston;

e. the reciprocating motion of the piston being allowed to move in relation to the stationary member so as to cause a changing flux field that induces a current in the coils that is conducted to the means for converting an electric signal to a form of usable electrical power.

10. The transducing means of claim 9(a) further comprising:

(a) A plurality of magnets, (b) A means for creating a low reluctance path for the magnetic flux, and (c) A plurality of coils mounted such that the magnetic flux through the coils will change over time, thereby inducing a time-varying electric signal.

11. The coils of claim 10(c) further being enclosed and isolated from the drilling fluid by an abrasive-resistant material selected from the group consisting of an austenitic stainless steel, a chrome plating, an elastomer, or a ceramic.

12. The means for converting the signal of claim 9(b) further comprising a means for converting the electric signal of claim 9(b) to one usable as a source of power for down-hole electric equipment.

13. The tool of claim 9 wherein the fluid driven percussive piston further comprises a housing, a main flow passage, at least one valve means, an impact surface, a backhead, a shank, one or more supply ports and passageways, one or more exhaust ports and passageways, elastomeric seals, bearings, seals, sliding valves, seal rings, keyways and keys, splines, shims, tiles, chambers, and a fluid selected from the class of natural or synthetic drilling fluids comprising air, water, brine, mud, or foam, or a combination thereof.

* * * * *